US005753082A

United States Patent [19]

Yoshida et al.

[11] Patent Number: 5,753,082

[45] Date of Patent: May 19, 1998

[54] BOTH-SIDED RECORDING PAPER FOR INK JET RECORDING AND METHOD OF PREPARING THE SAME

[75] Inventors: Yoshio Yoshida; Norio Fukushima; Michiko Okamoto; Tsuyoshi Yasuda; Yoshihiro Kuroyama, all of Tokyo, Japan

[73] Assignee: Nippon Paper Industries Company, Ltd., Tokyo, Japan

[21] Appl. No.: 623,922

[22] Filed: Mar. 28, 1996

[30] Foreign Application Priority Data

Mar. 29, 1995 [JP] Japan ..... 7-097735

[51] Int. Cl.[6] ..... D21F 11/00

[52] U.S. Cl. ..... 162/203; 162/135; 162/208; 428/331; 428/342

[58] Field of Search ..... 162/134, 135, 162/137, 203, 208, 300; 428/331, 342

[56] References Cited

U.S. PATENT DOCUMENTS 5,302,576 4/1994 Tokiyoshi et al. ..... 503/227
5,541,002 7/1996 Hosoi et al. ..... 428/537.5

FOREIGN PATENT DOCUMENTS 602400 11/1993 European Pat. Off. .
605840 12/1993 European Pat. Off. .
655346 5/1994 European Pat. Off. .

*Primary Examiner*—Donald E. Czaja
*Assistant Examiner*—Steven B. Leavitt
*Attorney, Agent, or Firm*—Millen, White, Zelano, & Branigan, P.C.

[57] ABSTRACT

Provided are a both-sided recording paper for ink jet recording which has coated layers comprising a pigment and a water-base binder on both sides of a base paper made from pulp slurry comprising a filler and an internal sizing agent; with the coated layers having a per side coverage of from 0.5 to 4.0 g/m$^2$, on a solids basis, and with the base paper having a basis weight of from 50 to 180 g/m$^2$, a total filler content within the range of 3 to 20 weight %, and a difference in filler content between surface layers extending to 30 μm below the front and rear surfaces of the base paper respectively within the range of 0 to 30% of the average value of filler contents in the surface layers: and a method of preparing the aforementioned both-sided recording paper.

14 Claims, 1 Drawing Sheet

BOTH-SIDED RECORDING PAPER FOR INK JET RECORDING AND METHOD OF PREPARING THE SAME

FIELD OF THE INVENTION

The present invention relates to a recording paper which enables ink jet recording on both sides thereof and, more particularly, to a both-sided ink jet recording paper which has all the appearance of plain paper and can ensure recording of fine quality.

BACKGROUND OF THE INVENTION

In an ink jet recording method, recording is carried out by jetting fine drops of ink using a variety of mechanisms so as to adhere to a recording paper, and thereby forming ink dots on the recording paper. Therefore, the recording method of ink jet type is noiseless, makes it easy to obtain full-color records and enables printing to be performed at a high speed, compared with the recording method of dot impact type.

In general, it is required of the paper used in the ink jet recording method to have properties of (1) ensuring high-speed drying of ink, (2) providing prints of high optical density, (3) inhibiting ink dots from spreading (or running), (4) ensuring a dot shape very close to round, and so on.

Due to recent development of high-definition color ink jet printers, a requirement has emerged for recording papers which can answer to such improvement in definition of printers. Further, from the latest need for saving resources, it has been urged to develop a recording paper which enables both-sided recording.

However, most of conventional high-grade ink jet recording papers of coated paper type and widely used ink jet recording papers of plain paper type permit the recording on one side alone, or even if the recording on both sides can be carried out, the recording quality is satisfactory on one side alone.

For the purpose of improving recording papers so as to meet the foregoing characteristics requirements for ink jet recording, various proposals have so far been made. For instance, there have been proposed the coated paper-type recording paper using a base paper having its Stöckigt sizing degree in the specified range(Japanese Tokkai Sho 52-53012), the recording paper having at least two coats of a synthetic silica-containing coating material to increase its coverage rate (Japanese Tokkai Sho 57-107879), the recording paper containing a filler inside and having a special distribution of voids (Japanese Tokkai Sho 58-110287), the recording paper provided an ink receiving layer on a support having a specified ratio between the upper and lower parts in thickness direction with respect to the sectional areas occupied by pigment (Japanese Tokkai Hei 6-25132), and the recording paper whose fibers are coated with superfine inorganic pigment at a coverage of at least 70% (Japanese Tokkai Hei 7-25132).

However, the coated papers proposed in those references have the disadvantages that the recording is limited to one side of the paper, the recording quality is poor because ink is spread over the paper to blur the recorded image, or the touch of the paper surface is quite different from that of plain paper.

Further, a base paper which is made under an insufficient control of the water removal on wire or a base paper prepared under a condition that the moisture is removed without control from the front and rear sides of paper in a press section has a difference in filler content between the front and rear surface parts thereof, and so the recording quality is considerably different between the front and rear sides when ink jet recording is performed on both sides of the paper.

Also, neutral paper containing calcium carbonate or the like as a filler has been widely used as ink jet recording paper because of its excellent archivability and high whiteness. While the calcium carbonate used as filler therein is effective for enhancement of whiteness and opacity, it has a defect of lowering the optical density of recorded images when it is present in large quantity at the recording surface.

In addition, when a difference in filler content is present between the front and rear surface layers of paper, as mentioned above, remarkable differences in the optical density of recorded image and the ruining extent of ink arise between the front and rear sides of the paper.

As for the recording paper of plain paper type, on the other hand, the optical density of images printed thereon can be heightened by reducing the filler content therein to the greatest possible extent, but the reduction in filler content results in heightening the transparency of the paper to cause print-through (or a phenomenon that the recorded images are seen through the paper on the non-recorded side).

When images are recorded on an ink jet recording paper of plain paper type with an ink jet printer, most of the ink laid on the recording paper permeates into its base paper, and so the extent of print-through, the extent of ink running, the optical density of recorded image and the color reproductivity of ink are influenced by the filler content in the base paper. In this case, however, increasing the filler content with the intention of heightening the hiding power of the base paper to prevent print-through from occurring causes the lowering of the optical density and the color reproductivity. Therefore, it becomes important to properly control the filler content in a base paper.

SUMMARY OF THE INVENTION

In order to obviate the aforementioned defects, the Inventors have made precise examination of the relation between the distribution of a filler content in the thickness direction of a base paper used for ink jet recording paper and the quality of images recorded on the ink jet recording paper with an ink jet printer. As a result thereof, it has been found that a filler content in the intermediate layer of the base paper, a filler content in each of the layers extending to about 30 μm below the front and rear surfaces of the base paper, and the difference between them had great influences upon a difference in recording quality between the front and rear sides of a recording paper. More specifically, the present invention has been derived from the discovery that since, in ink jet recording, recording ink which has penetrated into a zone extending to about 25–30 μm below the paper surface constitutes substantial contributions to recording qualities, including optical density of recorded images, color reproductivity of ink, runnability of ink and so on, these recording qualities on each side of the recording paper can be improved by properly controlling the filler content in the aforesaid ink penetrating zone.

Therefore, a first object of the present invention is to provide a both-sided recording paper for ink jet recording which can ensure excellent recording qualities, including high optical density of recorded image, on both sides when it undergoes ink jet recording at both front and rear surfaces thereof.

A second object of the present invention is to provide a both-sided recording paper for ink jet recording which is free from print-through when it undergoes ink jet recording at both front and rear surfaces thereof.

A third object of the present invention is to provide a method of preparing a recording paper for ink jet recording which has suitability for both-sided recording.

The above-described objects are attained with a both-sided recording paper for ink jet recording which has coated layers comprising a pigment and a water-base binder on both sides of a base paper made from pulp slurry comprising a filler and an internal sizing agent; with the coated layers having a per side coverage of from 0.5 to 4.0 g/m$^2$, on a solids basis, and with the base paper having a basis weight of from 50 to 180 g/m$^2$, a total filler content within the range of 3 to 20 weight %, and a difference in filler content between surface layers extending to 30 μm below the front and rear surfaces of the base paper respectively within the range of 0 to 30% of the average value of filler contents in the surface layers: and a method of preparing the aforementioned both-sided recording paper.

DETAILED DESCRIPTION OF THE INVENTION

Figure 1:
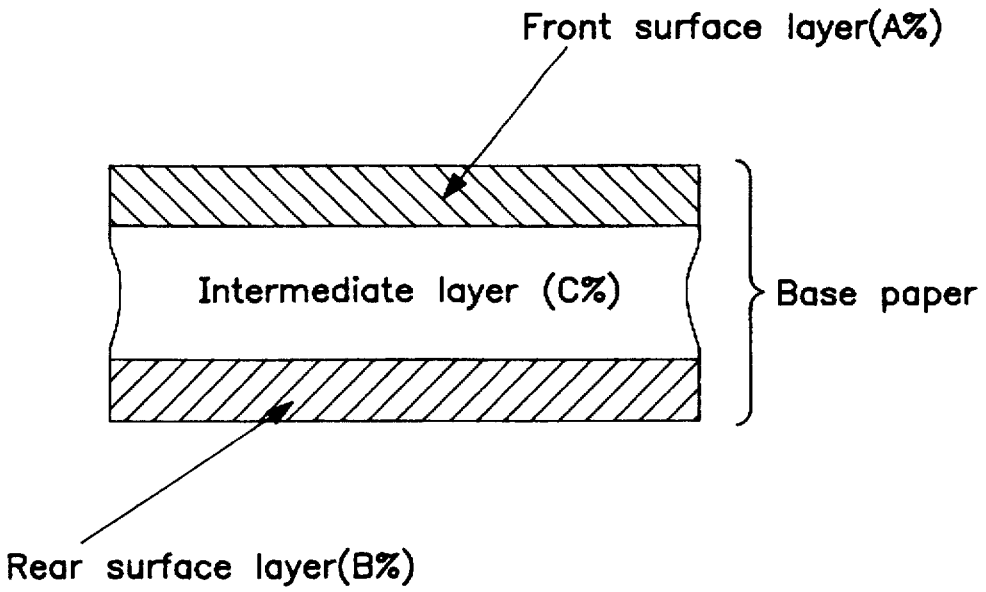
FIG. 1 is a schematic diagram showing a filler content distribution in the thickness direction of a base paper. Therein, A denotes a filler content in the layer extending to about 30 μm below the front surface of the base paper, B denotes a filler content in the intermediate layer of the base paper, and C denotes a filler content in the layer extending to about 30 μm below the rear surface of the base paper.

Fillers used in the present invention are not limited to particular species, so they can be selected properly from known fillers. Examples of usable fillers include talc, kaolin, illite, clay, calcium carbonate and titanium oxide. Also, these fillers can be used as a mixture of two or more thereof.

When titanium oxide, calcium carbonate and the like are used, a drop in optical density of recorded image tends to occur because of their optical characteristics. Therefore, it is desirable that the filler content in paper be reduced to the greatest possible extent so far as print-through is not caused thereby, or that another filler be used in combination with such fillers. In the present invention, however, it is preferable that kaolin alone, illite alone or the combination of kaolin with illite be used as filler.

The total filler content in a base paper used in the present invention ranges from 3 to 20 weight %, particularly preferably from 5 to 15 weight %. When the total filler content is less than 3 weight %, the opacity of the base paper is lowered to cause print-through and ink spreads in the form of feather although the optical density of images obtained by ink jet recording can be heightened; while when the total filler content is more than 20 weight %, not only the optical density of recorded image and the color reproductivity of ink are deteriorated but also stiffness of recording paper is lowered although print-through is prevented from occurring and drying speed of ink is satisfactory.

In particular, it is desirable for the present invention that both the filler content in a layer extending to 30 μm below the front surface of the base paper (which is hereinafter called "front surface layer") and the filler content in a layer extending to 30 μm below the rear surface of the base paper (which is hereinafter called "rear surface layer") be within the range of 3 to 15 weight % throughout the respective layers. When the filler content in each surface layer is less than 3 weight %, the printed ink tends to spread in the form of feather although the optical density of recorded image can be heightened; while when the filler content therein is increased beyond 15 weight %, the optical density of recorded image and the color reproductivity of ink are lowered.

From the standpoint of reducing the difference in recording quality between the front and rear surfaces of a recording paper when ink jet recording is performed on both sides of the recording paper, it is required of the base paper used in the present invention that the difference in filler content between the layers which extend to 30 μm below the front and rear surfaces of the base paper respectively be within the range of 0 to 30% of the average value of filler contents in those front and rear surface layers. When the difference in filler content is greater than 30% of the average value, the optical density of images recorded with an ink jet printer and the spreading condition of ink differ markedly between the front and rear surfaces. Additionally, the expression "the difference in filler content is 0%" signifies that the front surface layer and the rear surface layer are equal in filler content.

In making paper with a Fourdrinier machine, the control of filler contents in the front and rear surface layers of the paper can be carried out by using a retention aid and controlling the drainage on wire and the demoisturization on each side of the paper in the press section. In the present invention, however, it is especially desirable to use a twin-wire paper machine wherein water is removed from the top and bottom sides of pulp slurry, thereby achieving less filler content in the outermost layers of paper than in the center part of the paper.

To the base paper used in the present invention, retention aids for fillers, dyes and colored pigments for the control of hue, fluorescent dyes for improvement in visual whiteness, and so on can be further added.

Suitable examples of such a retention aid include polyacrylamides, polyethyleneimines, polyethylene oxides and cationized starch.

Internal sizing agents used in the present invention are not limited to particular species, so they can be chosen properly from conventional internal sizing agents for ink jet recording papers.

However, emulsion type sizing agents comprising rosin rendered hydrophobic by modification are preferably used in the present invention. Such an internal sizing agent is used in an amount of from 0.1 to 0.7 part by weight per 100 parts by bone dry weight of pulp.

The base paper used in the present invention has a basis weight ranging from 50 to 180 g/m$^2$. When the basis weight of a base paper is less than 50 g/m$^2$, the resulting recording paper is poor in stiffness, and so it cannot have desirable traveling properties when loaded in an ink jet printer. In other words, it is not easy to handle because jamming troubles and the like are apt to be caused during recording with an ink jet printer. When the basis weight is increased beyond 180 g/m$^2$, on the other hand, the recording paper obtained becomes too stiff, traveling troubles such as feeding failures are caused during recording with an ink jet printer.

If the filler content in the front surface layer, which extends to about 30 μm below the front surface of a base paper, is represented by A weight %, and that in the rear surface layer, which extends to 30 μm below the rear surface of a base paper, is represented by B weight %, as shown in FIG. 1, the base paper used in the present invention is required to satisfy the following relation:

$$0 \leqq \{(A-B)/(A+B)/2\} \times 100 \leqq 30$$

That is, the difference in filler content between the front surface layer and the rear surface layer, (A–B), is within the range of 0 to 30% of the average value of filler contents in the front and rear surface layers, (A+B)/2. In addition to this requirement, it is required of the present base paper that the total filler content therein be from 3 to 20 weight % and a coating be provided on each side of the base paper at a coverage of 0.5 to 4.0 g/m$^2$, on solids basis.

From the viewpoints of conferring excellent recording characteristics and a feel like plain paper on the present base paper, the coating provided on each side of the base paper is constituted of at least a pigment and a water-base binder and the coverage thereof is controlled to from 0.5 to 4.0 g/m$^2$, on solids basis. When the coverage on one side is less than 0.5 g/m$^2$, the ink used in ink jet recording tends to spread in the form of feather in the recorded areas and the optical density of recorded image is lowered; while when it is increased beyond 4.0 g/m$^2$, pigments and the like are liable to come off, whereby not only the ink jet nozzle of a printer tends to become clogged in the course of ink jet recording but also the recording paper surface comes to have a powdery touch losing the feel of plain paper.

Examples of a pigment which can be used include synthetic silica, magnesium carbonate, alumina, talc, kaolin, illite, clay and calcium carbonate.

Of these pigments, synthetic silica is preferred over the others from the viewpoints of enhancing the optical density of recorded image and the color reproductivity of ink. Additionally, the above-cited pigments may be used as a mixture of two or more thereof or as a mixture with other pigments uncited above so far as the effects of the present invention are not marred.

The water-base binder used in the present invention has no particular restriction so far as it is selected from aqueous resins and emulsions which have strong adhesion to pigments and the base paper and cause no blocking phenomenon between recording papers.

Suitable examples of such a water-base binder include polyvinyl alcohol, starch including oxidized starch, esterified starch, enzymatically denatured starch, cationized starch and so on, casein, soybean protein, cellulose derivatives including carboxy-methyl cellulose, hydroxyethyl cellulose and the like, a styrene-acrylic resin, an isobutylene-maleic anhydride resin, an acrylic emulsion, a vinyl acetate emulsion, a vinylidene chloride emulsion, a polyester emulsion, a styrene-butadiene latex and an acrylnitrile-butadiene latex. These binders can be used alone or as a mixture of two or more thereof.

In the coatings of the present invention, it is desirable to incorporate a cationic water-soluble polymer from the viewpoint of conferring water resistance on the recorded images.

Suitable examples of such a cationic water-soluble polymer include quaternary ammonium salt derivatives of polyethyleneimines, polyamide epichlorohydrin resins, cationic polyvinyl alcohols and cationic starch. These polymers may be used alone or as a mixture of two or more thereof. These cationic water-soluble polymers can be used in an appropriate amount so far as they produce no adverse effects upon the present recording paper.

To a coating solution for the coatings may also be added a surface sizing agent, an anti-foaming agent, a pH adjuster and other conventional additives, if desired, so far as the effects of the present invention are not marred by the addition thereof.

The coatings can be provided by known various methods, such as a size press coating method, coating methods using various blades, a roll coating method, an air-knife coating method, a bar coating method and so on. In particular, a size press coating method is preferred from the viewpoints of operation efficiency and cost.

It is desirable to prepare the present both-sided recording paper for ink jet recording by using a twin-wire paper machine provided with a wire section in which, upon removal of water from pulp slurry comprising such a filler and an internal sizing agent as cited above, the ratio of the amount of water removed from the top side corresponding to the front surface side of the base paper to the amount of water removed from the bottom side corresponding to the rear side of the base paper (the so-called top/bottom ratio) is adjusted to the range of 0.1 to 0.3, and making a base paper from the aforesaid pulp slurry so as to have a basis weight of from 50 to 180 g/m$^2$ and a total filler content of from 3 to 20 weight %, and further providing a coating constituted at least of a pigment and a water-base binder on each side of the base paper at a coverage of 0.5 to 4.0 g/m$^2$, on a solids basis.

Since in the present both-sided recording paper for ink jet recording, as mentioned in detail above, not only the difference in filler content between the layer extending to 30 μm below the front surface of the base paper and the layer extending to 30 μm below the rear surface of the base paper is within the range of 0 to 30% of the average value of filler contents in the above-defined layers, but also the coating on each side of the base paper has a coverage of 0.5 to 4.0 g/m$^2$ on a solids basis, the present recording paper can ensure high densities in images recorded on both sides without causing print-through although it is a light-weight coated paper, and the images recorded on both sides thereof have high quality and are slightly different in quality from each other.

The present invention will now be illustrated in more detail by reference to the following examples. However, the invention should not be construed as being limited to these examples. Unless otherwise noted, all "%" and all "parts" in the examples are by weight.

Additionally, the tests made in the examples and evaluation criteria are described below.

(1) Filler Content in Base Paper: The method defined in JIS P8003, wherein correction for a decrease in ash upon exposure to strong heat is made, is adopted for determination thereof.

(2) Division of Paper into Layers: Paper is divided into layers with adhesive peeling tape or a freeze splitting test machine for wet paper (Sheet Splitter, made by Kumagai Riki Kogyo Co., Ltd.).

(3) Optical Densities of Recorded images: A prescribed pattern is recorded with a DeskJet 505J (made by HEWLETT PACKARD), and the optical densities of black solid areas are measured with a Macbeth densitometer RD514. A difference in optical density between the solid area on the front surface and that on the rear surface is evaluated in accordance with the following criterion;

○ The difference ranges from 0 to 0.03.

Δ The difference ranges from 0.04 to 0.06.

× The difference ranges from 0.07 to 0.1.

×× The difference is greater than 0.1.

(4) Spread of Ink: A prescribed pattern is recorded with a DeskJet 505J (made by HEWLETT PACKARD), and the feather-form spread of ink is evaluated by visual observation in accordance with the following criterion;

○ There is no spread of ink in feather form.

Δ There is some spread of ink in feather form.

× There is much spread of ink in feather form.

(5) Thickening of Printed Letters: Letters are printed with a DeskJet 505J (made by HEWLETT PACKARD), and the defacing extent of the printed letters is evaluated by visual observation in accordance with the following criterion;

○ Printed letters are clears so it is easy to read them.

Δ Some thickening is caused in printed letters, so it is somewhat difficult to read them.

× Printed letters are considerably thickened, so it is difficult to read them.

(6) Print-Through: A prescribed pattern is recorded with a DeskJet 505J (made by HEWLETT PACKARD), and the recorded pattern is observed from the side opposite to the recorded face. To what extent the pattern can be seen through is evaluated in accordance with the following criterion;

○ The recorded pattern is not seen through.

Δ Part of the recorded pattern is seen through.

× The recorded pattern, as a whole, is seen through.

(7) Travelling Properties in Printer: Recording is performed with a DeskJet 505J (made by HEWLETT PACKARD), and the travelling properties of a recording paper is evaluated in accordance with the following criterion;

○ Feeding of recording papers is smooth.

Δ Feeding in a poor condition or jamming occurs sometimes.

× Feeding in a poor condition or jamming occurs frequently.

(8) Texture: The sensory test by the touch is carried out, and thereby the texture is evaluated in accordance with the following criterion:

○ The touch is similar to that of plain paper.

× The touch is akin to that of a coated paper.

(9) Water resistance: The recording paper with recorded images is soaked in water for 15 minutes, and then dried spontaneously. The resulting images are evaluated by visual observation in accordance with the following criterion;

○ No change is observed in the images.

Δ Part of the images is blurred.

× Most of the image-forming ink has drained away.

EXAMPLE 1

From a paper stock prepared by adding 5 parts of ground calcium carbonate, 1.0 part of aluminum sulphate, 1 part of cationized starch, 0.1 part of a sizing agent and 0.02 part of a retention aid to 100 parts, based on bone dry pulp, of pulp slurry comprising hardwood bleached sulphate pulp (L-BKP) having a Canadian standard freenes of 400 ml, a base paper was made by means of a twin-wire paper machine as the amounts of water removed from the top and bottom sides in the wire section were both controlled. The thus obtained base paper, which had a basis weight of 55 g/m$^2$, was coated on both sides with the following coating composition I by means of a size press so that the per side coverage is 0.8 g/m$^2$, on a solids basis, thereby obtaining a both-sided ink jet recording paper according to the present invention.

Coating Composition I:

Synthetic silica [Finesil (specific surface area: 270 m$^2$/g), trade name, a product of Tokuyama Soda Co., Ltd.]
100 parts Water-base binder [Polyvinyl alcohol, Kuraray 117, trade name, a product of Kuraray Co., Ltd.]
25 parts Cationic water-soluble polymer [PCL-1, trade name, a product of SENKA CORPORATION]
35 parts Anti-foaming agent [Foamaster AP, trade name, a product of San Nopco Ltd.]
0.05 part

EXAMPLE 2

From a paper stock prepared by adding 6 parts of kaolin, 2.0 part of aluminum sulphate, 1 part of cationized starch, 0.2 part of a sizing agent and 0.02 part of a retention aid to 100 parts, based on bone dry pulp, of pulp slurry comprising hardwood bleached sulphate pulp (L-BKP) having a Canadian standard freenes of 410 ml, a base paper was made by means of a twin-wire paper machine as the amounts of water removed from the top and bottom sides in the wire section were both controlled. The thus obtained base paper, which had a basis weight of 78 g/m$^2$, was coated on both sides with the following coating composition II by means of a size press so that the per side coverage might be 1.5 g/m$^2$, on a solids basis, thereby obtaining a both-sided ink jet recording paper according to the present invention.

Coating Composition II:

Synthetic silica [Aerozil (specific surface area: 200 m$^2$/g), trade name, a product of Nippon Aerozil Co., Ltd.]
100 parts Water-base binder [Polyvinyl alcohol, Kuraray 105, trade name, a product of Kuraray Co., Ltd.]
20 parts Cationic water-soluble polymer [PCL-1, trade name, a product of SENKA CORPORATION.]
25 parts Anti-foaming agent [Foamaster AP, trade name, a product of San Nopco LTD.]
0.05 part

EXAMPLE 3

Another both-sided ink jet recording paper according to the present invention was prepared in the same manner as in Example 2, except that the per side coverage of the coating composition was changed to 3.0 g/m$^2$.

EXAMPLE 4

From a paper stock prepared by adding 12.5 parts of kaolin, 2.0 parts of aluminum sulphate, 1 part of cationized starch, 0.2 part of a sizing agent and 0.02 part of a retention aid to 100 parts, based on bone dry pulp, of pulp slurry comprising hardwood bleached sulphate pulp (L-BKP) having a Canadian standard freenes of 410 ml, a base paper was made by means of a twin-wire paper machine as the amounts of water removed from the top and bottom sides in the wire section were both controlled. The thus obtained base paper, which had a basis weight of 78 g/m$^2$, was coated on both sides with the following coating composition III by means of a size press so that the per side coverage is 2.0 g/m$^2$, on a solids basis, thereby obtaining a both-sided ink jet recording paper according to the present invention.

Coating Composition III:

Synthetic silica [Mizukasil (specific surface area: 300–350 m$^2$/g), trade name, a product of Mizusawa Industrial Chemicals, Ltd.]
100 parts Water-base binder [GOHSENOL, trade name, a product of NIPPON SYNTHETIC CHEMICAL INDUSTRY CO., LTD.]
20 parts Cationic water-soluble polymer [PCL-1, trade name, a product of SENKA CORPORATION.]
25 parts Anti-foaming agent [Foamaster AP, trade name, a product of San Nopco LTD.]
0.05 part

EXAMPLE 5

From a paper stock prepared by adding 22 parts of illite, 2.0 part of aluminum sulphate, 1 part of cationized starch, 0.2 part of a sizing agent and 0.02 part of a retention aid to 100 parts, based on bone dry pulp, of pulp slurry comprising hardwood bleached sulphate pulp (L-BKP) having a Canadian standard freenes of 410 ml, a base paper was made by means of a twin-wire paper machine as the amounts of water removed from the top and bottom sides in the wire section were both controlled. The thus obtained base paper, which had a basis weight of 172 g/m$^2$, was coated on both sides with the following coating composition IV by means of a size press so that the per side coverage is therefore 3.9 g/m$^2$, on a solids basis, thereby obtaining a both-sided ink jet recording paper according to the present invention.

Coating Composition IV:

Synthetic silica [Mizukasil (specific surface area: 140 m$^2$/g), trade name, a product of Mizusawa industrial chemicals, Ltd.]
100 parts Water-base binder [GOHSENOL, trade name, a product of NIPPON SYNTHETIC CHEMICAL INDUSTRY CO., LTD.]
20 parts Cationic water-soluble polymer [PCL-1, trade name, a product of SENKA CORPORATION.]
25 parts Anti-foaming agent [Foamaster AP, trade name, a product of San Nopco LTD.]
0.05 part

EXAMPLE 6

A further both-sided ink jet recording paper according to the present invention was prepared in the same manner as in Example 4, except that the cationized water-soluble polymer was removed from the coating composition III.

COMPARATIVE EXAMPLE 1

An ink jet recording paper was prepared in the same manner as in Example 2, except that the per side coverage of the Coating Composition II was changed to 0.2 g/m$^2$, on a solids basis.

COMPARATIVE EXAMPLE 2

An ink jet recording paper was prepared in the same manner as in Example 1, except that the paper stock used was free from ground calcium carbonate and the per side coverage of the Coating Composition I was changed to 5 g/m$^2$, on a solids basis.

COMPARATIVE EXAMPLE 3

An ink jet recording paper was prepared in the same manner as in Example 1, except that the basis weight of base paper was changed to 200 g/m$^2$ by changing the proportion of ground calcium carbonate in the paper stock to 32 wt % and controlling the drainage on both sides and the per side coverage of the Coating Composition I was changed to 2.1 g/m$^2$, on a solids basis.

COMPARATIVE EXAMPLE 4

An ink jet recording paper was prepared in the same manner as in Example 4, except that the twin-wire paper machine was replaced by a Fourdrinier paper machine and the per side coverage of the Coating Composition III was changed to 3.8 g/m$^2$, on a solids basis.

COMPARATIVE EXAMPLE 5

An ink jet recording paper was prepared in the same manner as in Example 4, except that the per side coverage of the Coating Composition III was changed to 5 g/m$^2$, on a solids basis.

COMPARATIVE EXAMPLE 6

An ink jet recording paper was prepared in the same manner as in Example 1, except that the basis weight of base paper was changed to 45 g/m$^2$.

Paper qualities and image-quality evaluation results of ink jet recording papers obtained in the foregoing Examples and Comparative Examples are set forth in Table 1 and Table 2.

TABLE 1

| | | | Filler Content in Paper (%) | | | | | | |
|---|---|---|---|---|---|---|---|---|---|
| | Basis weight g/m$^2$ | Filler | Total | Front surface layer (A) | Inter-mediate layer (C) | Rear surface layer (B) | Average (A + B)/2 = X | Difference (A − B) = Y | Ratio (%) (Y/X) × 100 |
| Example 1 | 55 | $CaCo_3$ | 3.5 | 3.4 | 4.0 | 3.1 | 3.3 | 0.3 | 9.1 |
| Example 2 | 78 | kaolin | 5.0 | 4.2 | 6.5 | 3.6 | 3.9 | 0.6 | 15.4 |
| Example 3 | 78 | kaolin | 5.0 | 4.2 | 6.5 | 3.6 | 3.9 | 0.6 | 15.4 |
| Example 4 | 78 | kaolin | 10.0 | 9.5 | 12.1 | 7.4 | 8.5 | 2.1 | 24.7 |
| Example 5 | 172 | illite | 18.5 | 14.3 | 20.5 | 12.3 | 13.3 | 2.0 | 15.0 |
| Example 6 | 78 | kaolin | 10.0 | 9.5 | 12.1 | 7.4 | 8.5 | 2.1 | 24.7 |
| Compar. Ex. 1 | 78 | kaolin | 5.0 | 4.2 | 6.5 | 3.6 | 3.9 | 0.6 | 15.4 |
| Compar. Ex. 2 | 55 | — | 0.0 | — | — | — | — | — | — |
| Compar. Ex. 3 | 200 | $CaCo_3$ | 24.0 | 19.7 | 26.5 | 12.5 | 16.1 | 7.2 | 44.7 |
| Compar. Ex. 4 | 78 | kaolin | 10.4 | 11.5 | 11.7 | 7.4 | 9.5 | 4.1 | 43.1 |
| Compar. Ex. 5 | 78 | kaolin | 10.0 | 9.5 | 12.1 | 7.4 | 8.5 | 2.1 | 24.7 |
| Compar. Ex. 6 | 45 | $CaCo_3$ | 3.5 | 3.6 | — | 3.4 | 3.5 | 0.2 | 5.7 |

TABLE 2

| | Coverage* g/m² | Optical Density of recorded image: Measured value | Optical Density of recorded image: Difference | Spread of Ink Front/Rear | Thickening Front/Rear | Water Resistance | Print through | Texture | Travelling Properties |
|---|---|---|---|---|---|---|---|---|---|
| Example 1 | 0.8 | 1.21 | ○ | ○/ ○ | ○/ ○ | ○ | ○ | ○ | ○ |
| Example 2 | 1.5 | 1.22 | ○ | ○/○ | ○/○ | ○ | ○ | ○ | ○ |
| Example 3 | 3.0 | 1.25 | ○ | ○/○ | ○/○ | ○ | ○ | ○ | ○ |
| Example 4 | 2.0 | 1.22 | ○ | ○/○ | ○/○ | ○ | ○ | ○ | ○ |
| Example 5 | 3.8 | 1.20 | ○ | ○/○ | ○/○ | ○ | ○ | ○ | ○ |
| Example 6 | 2.0 | 1.20 | ○ | ○/○ | ○/○ | X | ○ | ○ | ○ |
| Compar. Ex. 1 | 0.2 | 1.10 | ○ | Δ/X | ○/○ | Δ | ○ | ○ | ○ |
| Compar. Ex. 2 | 5.0 | 1.27 | ○ | X/X | ○/○ | ○ | X | X | ○ |
| Compar. Ex. 3 | 2.1 | 1.07 | X | ○/○ | X/○ | ○ | ○ | ○ | Δ no good |
| Compar. Ex. 4 | 3.8 | 1.22 | X | ○/○ | Δ/○ | ○ | ○ | ○ | ○ |
| Compar. Ex. 5 | 5.0 | 1.20 | ○ | ○/○ | ○/○ | ○ | ○ | X | ○ |
| Compar. Ex. 6 | 0.8 | 1.20 | ○ | ○/○ | Δ/Δ | ○ | X | ○ | Δ jamming |

*per side, solids basis.

What is claimed is:

1. A both-sided recording paper for ink jet recording which comprises a base paper having a front surface and a rear surface and coating layers on each of said front and rear surfaces:

wherein the difference between the filler content of a front portion of the base paper extending from the front surface to a depth of 30 μm into the base paper and the filler content of a rear portion of the base paper extending from the rear surface to a depth of 30 μm into the base paper is from 0 to 30% of the average of the filler contents of said portions;

wherein the base paper has a basis weight of from 50 to 180 g/m², a total filler content of from 3 to 20% and is made from a pulp slurry comprising a filler and sizing agent; and, wherein each coating layer comprises a pigment and a water-base binder and has a per surface coverage of from 0.5 to 3.8 g/m² on a solids basis.

2. The both-sided recording paper for ink jet recording of claim 1, wherein the filler content in the front portion of the base paper and the filler content in the rear portion of the base paper are each from 3 to 15 weight %.

3. The both-sided recording paper for ink jet recording of claim 2, wherein the pigment is synthetic silica.

4. The both-sided recording paper for ink jet recording of claim 2, wherein each of the coating layers further comprises a water-soluble cationic polymer.

5. The both-sided recording paper for ink jet recording of claim 2, wherein the filler contains kaolin.

6. The both-sided recording paper for ink jet recording of claim 1, wherein the pigment is synthetic silica.

7. The both-sided recording paper for ink jet recording of claim 6, wherein each of the coating layers further comprises a water-soluble cationic polymer.

8. The both-sided recording paper for ink jet recording of claim 1, wherein each of the coating layers further comprises a water-soluble cationic polymer.

9. The both-sided recording paper for ink jet recording of claim 1, wherein the filler contains kaolin.

10. The both-sided recording paper for ink jet recording of claim 1, wherein the filler is talc, kaolin, illite, clay, calcium carbonate, titanium oxide or a mixture thereof.

11. The both-sided recording paper for ink jet recording of claim 1, wherein the filler is kaolin, illite or a mixture thereof.

12. The both-sided recording paper for ink jet recording of claim 1, wherein the total filler content is 5 to 15% by weight.

13. The both-sided recording paper for ink jet recording of claim 1, wherein the filler content in each of the front portion and the rear portion of the base paper is less than the filler content of a balance of the base paper not in either portion.

14. A method for preparing a both-sided recording paper for ink jet printing, which comprises:

making a base paper, having a basis weight of from 50 to 180 g/m² and a total filler content of from 3 to 20% by weight, from a pulp slurry comprising a filler and internal sizing agent using a twin-wire paper machine arranged so that water is removed from a top side and a bottom side of the base paper, wherein the ratio of water removed from the top side to water removed from the bottom side is adjusted to from 0.1 to 0.3; and, applying a coating comprising a pigment and water-base binder on each of said top and bottom sides at a per side coverage of 0.5 to 3.8 g/m² on a solids basis.

* * * * *